US005421103A

United States Patent [19]

Wunderlich

[11] Patent Number: 5,421,103

[45] Date of Patent: Jun. 6, 1995

[54] APPARATUS AND METHOD FOR DRYING FABRICS

[75] Inventor: Daniel F. Wunderlich, Newton, Iowa

[73] Assignee: Maytag Corporation, Newton, Iowa

[21] Appl. No.: 157,624

[22] Filed: Nov. 24, 1993

[51] Int. Cl.[6] ..... F26B 11/04

[52] U.S. Cl. ..... 34/599; 34/602

[58] Field of Search ..... 34/601, 602, 595, 599

[56] References Cited

U.S. PATENT DOCUMENTS 1,751,841 3/1930 Pickens .
3,155,462 11/1964 Erickson et al. .
3,321,846 5/1967 Heinicke .
3,668,784 6/1972 Teague, Jr. et al. .
4,703,565 11/1987 Kantor .

*Primary Examiner*—Henry A. Bennet
*Attorney, Agent, or Firm*—Zarley, McKee, Thomte, Voorhees & Sease

[57] ABSTRACT

A fabric dryer includes a cabinet having a tumbler assembly located within. The tumbler assembly includes a tumbler compartment having a tumbler opening therein. A pair of spaced apart tumblers are rotatably mounted within the tumbler compartment for movement in first and second circular paths which lie in planes canted with respect to one another. The tumbler opening remains stationary throughout rotation of the tumblers within the tumbler chamber.

20 Claims, 3 Drawing Sheets

APPARATUS AND METHOD FOR DRYING FABRICS

BACKGROUND OF THE INVENTION

This invention relates to an apparatus and method for drying fabrics.

Conventional fabric dryers utilize a rotating drum or tumbler on the inside of a cabinet. The drum or tumbler typically rotates about a horizontal axis which extends between the front wall and the back wall of the dryer, Access to the drum is provided by a door opening in the front wall of the cabinet. Hot air is introduced to the drum while it is rotating, and blades or tumbler baffles within the drum lift and cause the fabrics to tumble as the drum rotates so that the fabrics are exposed to the hot air to facilitate drying.

Various efforts have been made to provide a rotating drum fabric dryer which provides access from the top wall of the dryer rather than from the front wall, However, these prior art attempts have encountered the problem of providing satisfactory tumbling of the fabrics during rotation of the drum while at the same time providing an access opening to the drum from the top of the cabinet.

Therefore a primary object of the present invention is the provision of an improved apparatus and method for drying fabrics.

A further object of the present invention is the provision of an apparatus and method for drying fabrics which permits the operator to have access to the interior of the drying compartment from the top of the dryer.

A further object of the present invention is the provision of an improved apparatus and method for drying fabrics whereby the operator can have access to the drying compartment through the top of the dryer cabinet by merely opening a single door in the top of the cabinet.

A further object of the present invention is the provision of an improved apparatus and method for drying fabrics wherein access is provided at the top of the dryer cabinet, and yet satisfactory tumbling action is achieved through rotation of tumbler members within the drying compartment.

A further object of the present invention is the provision of an improved apparatus and method for drying fabrics which includes a tumbler assembly having a tumbler opening which remains open throughout the rotation of the tumblers within the tumbler assembly.

A further object of the present invention is the provision of an improved apparatus and method for drying fabrics which provides improved flow of hot air through the fabrics being tumbled during the drying action.

A further object of the present invention is the provision of an improved apparatus and method for drying fabrics which is economical to manufacture, durable in use, and efficient in operation.

SUMMARY OF THE INVENTION

The foregoing objects are achieved by a fabric dryer having a cabinet with a top wall, a front wall, a rear wall, and opposite side walls. A door opening is provided in the top wall of the cabinet and a door is movably mounted over the door opening for movement from a closed position covering the door opening to an open position uncovering the door opening. Within the cabinet is a tumbler assembly which forms a tumbler compartment therein. The tumbler assembly has a tumbler opening and a rotatable tumbling mechanism for causing the tumbling of fabrics within the tumbler compartment.

DESCRIPTION OF THE PREFERRED EMBODIMENTS

Figure 1:
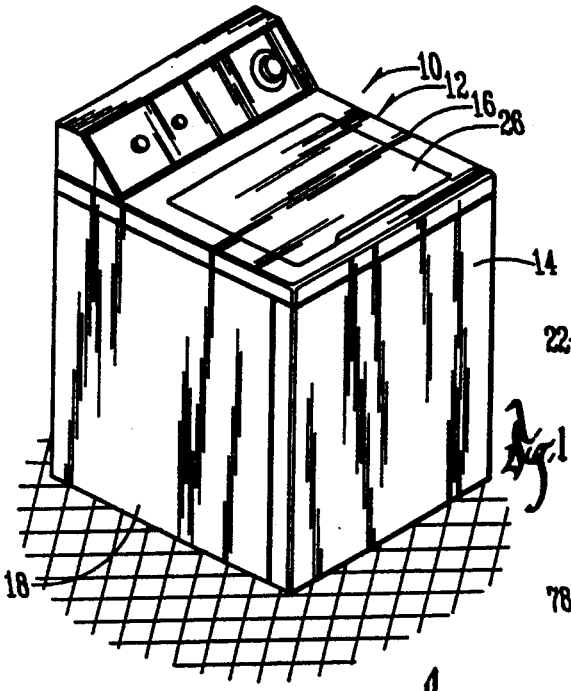
FIG. 1 is a pictorial view of the dryer of the present invention.
Figure 2:
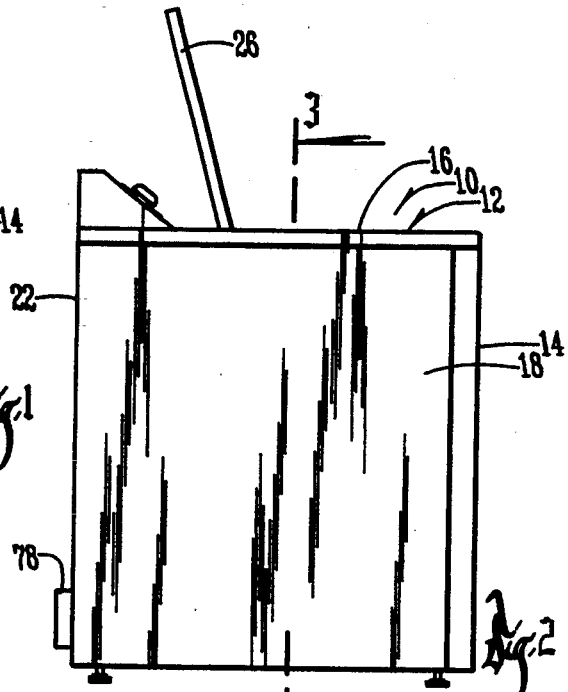
FIG. 2 is a side elevational view thereof.

Referring to the drawings the numeral 10 generally designates a clothes dryer of the present invention. Clothes dryer 10 includes a cabinet 12 having a front wall 14, top wall 16, side walls 18, 20, rear wall 22 and a base 23. A door opening 24 is provided in the top wall 16 of cabinet 12 and is provided with a cabinet door 26 hinged about door hinge 28. The door 26 is sealed with respect to the door opening 24 by a gasket 25.

A tumbler assembly 29 is mounted within the cabinet 12 to a framework 29 and includes a fixed tumbler housing 30 having canted side walls 32, 34 which form a tumbler chamber 36. Within the fixed tumbler housing 30 is an upwardly presented tumbler opening 38 provided in a rounded stationary tumbler wall 40. The side walls 32, 34 of fixed tumbler housing 30 are canted with respect to one another, being closest together adjacent the bottom rear portion of the tumbler assembly 29 and being the furthest apart adjacent the upper forward portion of the tumbler assembly 29 where the tumbler opening 38 is provided.

Figure 6:
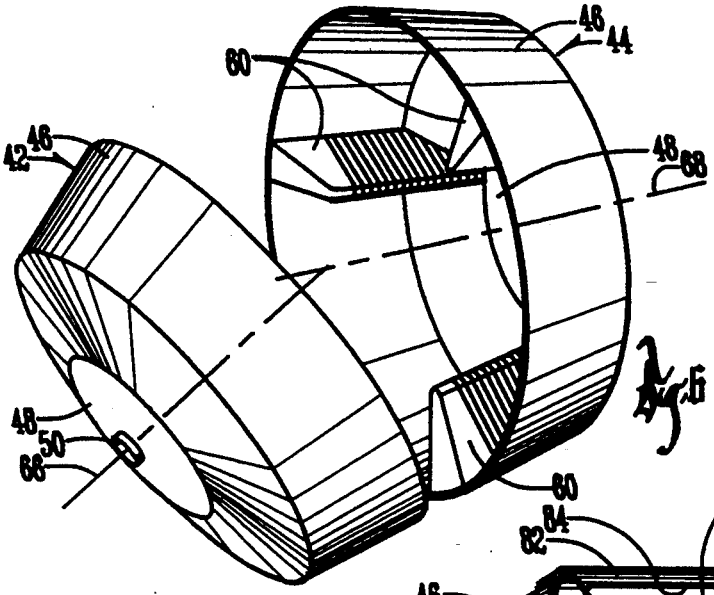
FIG. 6 is a schematic view showing the arrangement of the moving tumblers within the tumbler assembly.

Rotatably mounted to each of the canted side walls 32, 34 within the tumbler chamber 36 are a pair of circular tumbler members 42, 44. As can be seen best in FIG. 6, each of the tumbler members 42, 44 is shaped somewhat like a dishpan, with an annular tapered rim 46 and a circular end wall 48. A shaft 50 extends outwardly from the outside surface of the circular end walls 48 and extends through the canted side walls 32, 34 of the fixed tumbler housing 30 so as to rotatably mount the tumbler members 42, 44 to the inside of fixed tumbler housing 30 for rotation about two rotational axes 66, 68 which are canted with respect to one another as is illustrated in FIG. 6.

Mounted on the end of each shaft 50 is a pulley 52 having a belt 58 trained therearound. Belt 58 extends over a drive pulley 56 on a drive shaft 54 which is rotatably mounted in a pair of spaced apart bearing supports 88. A larger pulley 90 is fixed to shaft 54 and has a belt 94 trained around it and around a motor pulley (not shown) on motor 92. Thus the motor 92 drives the shaft 54 which in turn rotates the two tumbler members 42, 44 about the axes 66, 68.

Figure 3:
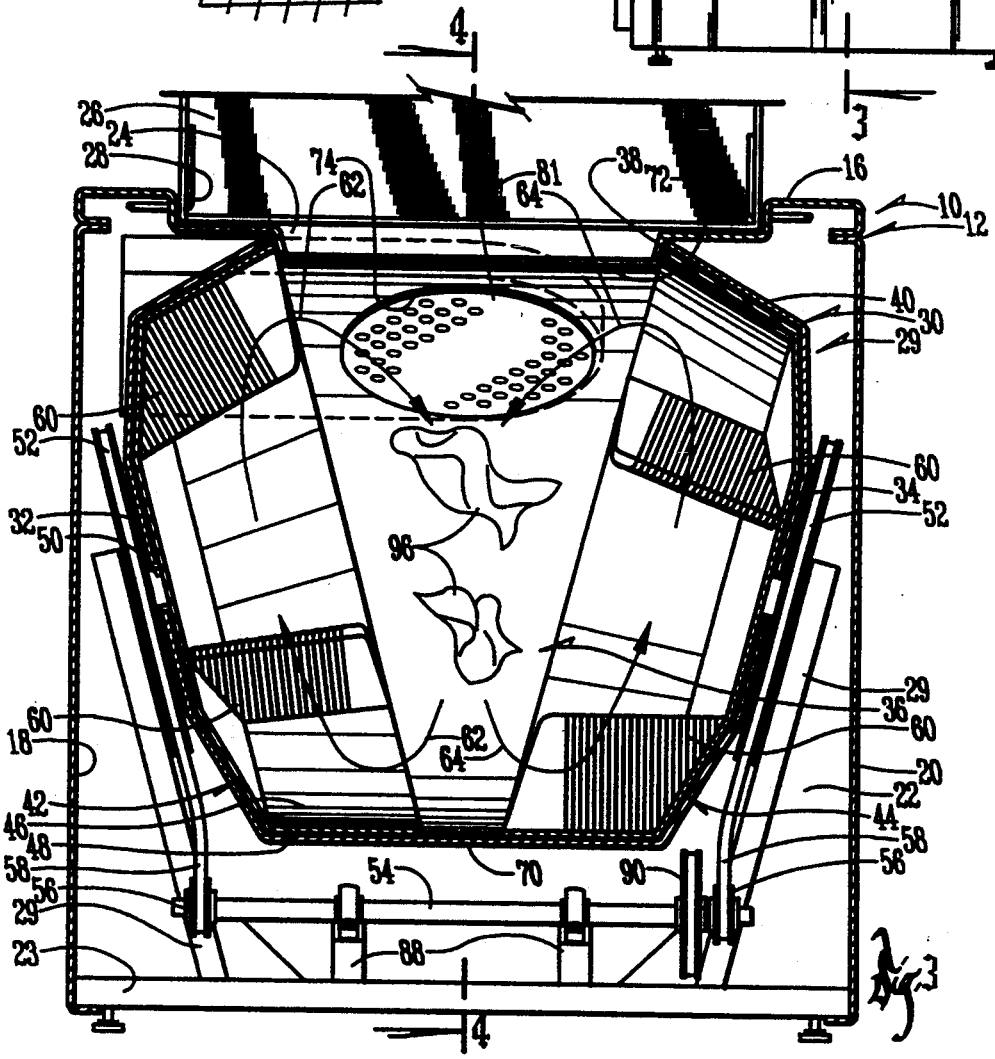
FIG. 3 is a sectional view taken along line 3–3 of FIG. 2.
Figure 5:
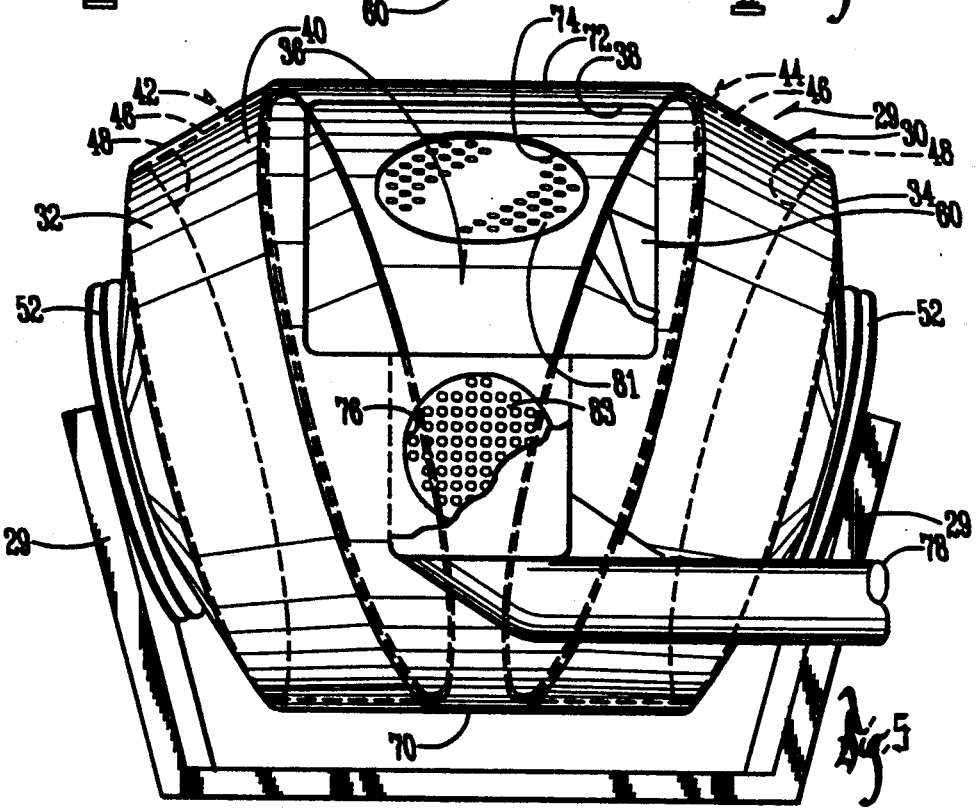
FIG. 5 is a front elevational view of the tumbler assembly with the dryer cabinet removed.

Each tumbler member 42, 44 includes a plurality of tumbler baffles 60 therein. Rotation of the tumbler members 42, 44 causes the tumbler baffles 60 to move in two separate circular paths indicated by arrows 62, 64 (FIG. 3) extending in two separate planes which are canted with respect to one another. The result of this configuration is that the rotatable members are close to one another at the bottom rear portion (designated 70) of each circle (see FIGS. 3 and 5) and which are spread apart a substantially greater distance at the upper front portions thereof designated by the numeral 72 (FIGS. 3 and 5). The widest portion as designated at 72 is adjacent the tumbler opening 38 so that the tumbler members 42, 44 do not obstruct the opening 38 during their rotation. This means that the opening 38 remains open to the interior of the tumbler chamber 36 at all times during the rotation of the tumbler members 42, 44.

Figure 4:
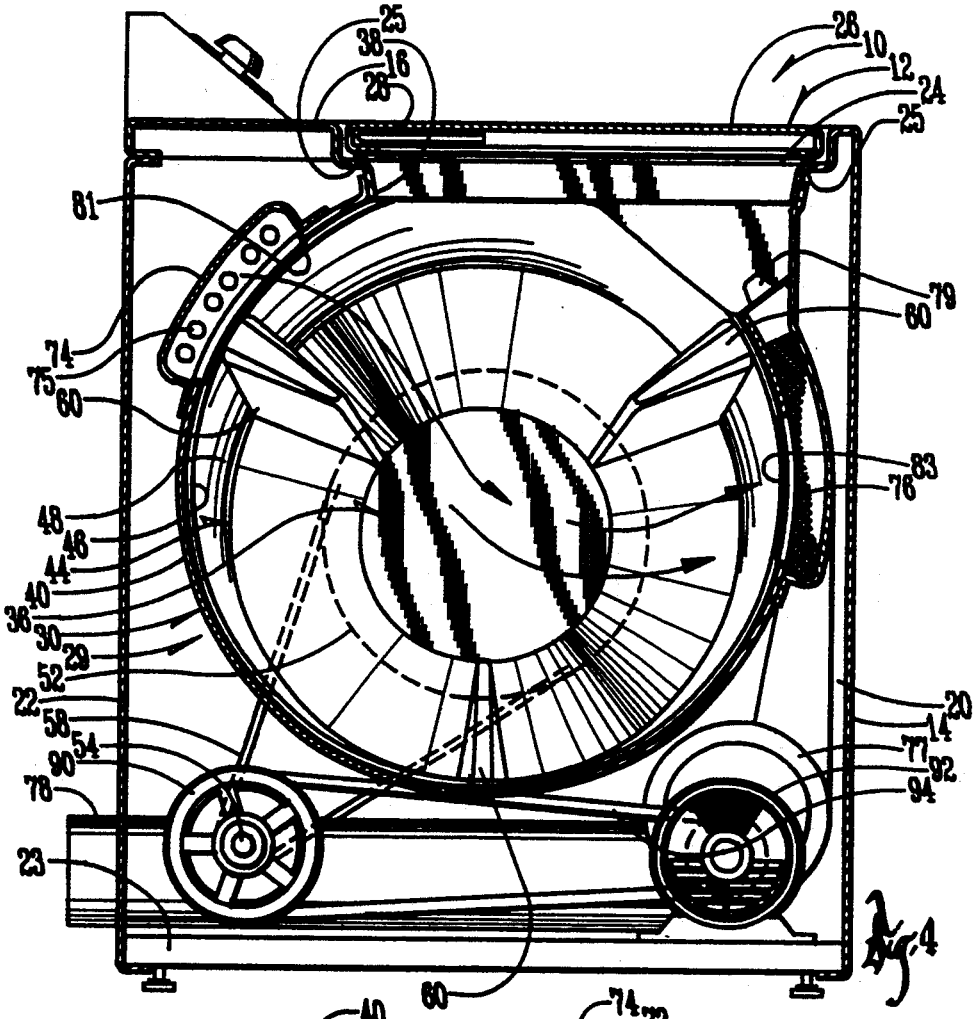
FIG. 4 is a sectional view taken along line 4–4 of FIG. 3.

As best shown in FIG. 4, fixed tumbler wall 40 includes a hot air inlet opening 74 over which is mounted a heater 75. The front portion of rounded wall 40 is provided with an air outlet opening 76 which is connected to a fan 77 and to the environment by means of a conduit 78. Openings 74 and 76 are preferably covered by perforated covers 81 and 83. The fan 77 draws air through heater 75 into chamber 36 through opening 74, through the fabrics being dried, out of chamber 36 through opening 76, through lint filter 79, through the fan 77 and outwardly through conduit 78 at the rear of the cabinet 12.

In operation, the fabrics 96 to be dried are inserted through tumbler opening 38 into the interior tumbler chamber 36. The cabinet door 26 is closed, and the motor 92 is started. This causes rotation of the tumblers members 42, 44 in the direction indicated by arrows 62, 64 (FIG. 3).

Figure 8:
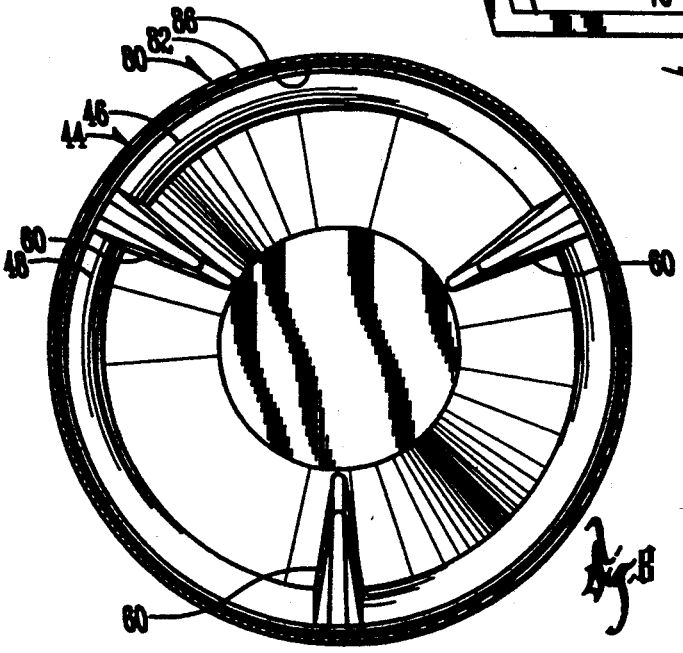
FIG. 8 is a sectional view taken along line 8–8 of FIG. 7.

The fabrics are grasped by the baffles or fabric grapsing members 60 adjacent the narrow portion 70 between the two rotating tumbler members 42, 44. They are carried upwardly, and tossed toward the central portion of the tumbler chamber 36 in the manner shown in FIG. 3. It has been found that the fabrics follow a FIG. 8 pattern, being lifted first by one of the tumbler members 42, 44, and then being thrown over toward the other of the tumbler members 42, 44 and circulated by that other tumbler. The result is a FIG. 8 motion of the fabrics within the tumbler chamber 36.

At the same time the heater 75 is actuated, and the fan 77 is actuated to move hot air into and out of the tumbler chamber 36 through air inlet 74 and air outlet 76. This causes a hot air stream to pass from hot air inlet 74 to air outlet 76 from the upper rear of the chamber to the forward portion of the chamber. Thus the hot air stream moves in a path which is across the circular paths followed by the fabrics, thereby causing a thorough mixing of the air with the fabrics to facilitate drying.

Figure 7:
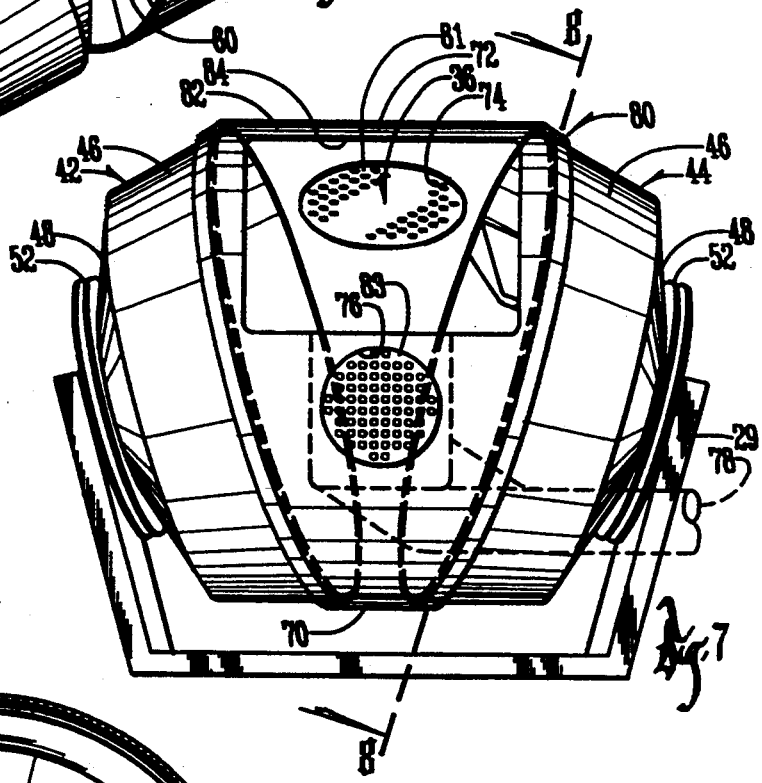
FIG. 7 is a front elevational view similar to FIG. 5, but showing a modified form of the invention.

Referring to FIG. 7, a modified form 80 of the tumbler assembly is shown. Corresponding parts between the tumbler assembly 80 of FIG. 7 and the tumbler assembly 29 of FIG. 5 carry corresponding numerals. Tumbler assembly 80 includes a wrap around fixed wall 82 which does not form by itself a complete enclosed chamber as is provided by tumbler housing 30. Instead the wrap around fixed wall 82 combines with the two rotatable tumbler members 42, 44 to provide the tumbler chamber 36. The wrap around fixed wall 82 also, provides a tumbler opening 84 which is comparable to the tumbler opening 38 shown in FIG. 5. Surrounding the juncture between the rotatable members 42, 44 and the fixed wall 80 is a circular felt seal 86 which provides a sealing therebetween. The seal 86 may be attached either to the movable members 42, 44 or to the fixed wall 80 without detracting from the invention.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

I claim:

1. A fabric dryer comprising:

a cabinet having a top wall, a front wall, a rear wall, and opposite side walls;

a tumbler assembly within said cabinet forming a tumbler compartment therein, said tumbler assembly having a tumbler opening therein, and having a rotatable tumbling mechanism for causing tumbling of fabrics within said tumbler compartment;

a heater for providing heated air to said tumbler compartment;

said cabinet having a cabinet door opening therein providing access to said tumbler opening and to said tumbler compartment;

a door movably mounted to said cabinet for movement from a closed position covering said door opening to an open position uncovering said door opening.

2. A fabric dryer according to claim 1 wherein that portion of said tumbler assembly containing said tumbler opening is stationary.

3. A fabric dryer according to claim 2 wherein said tumbler opening is substantially upwardly presented.

4. A fabric dryer according to claim 1 wherein said tumbler assembly includes a fixed tumbler housing, said tumbler opening being formed in said fixed tumbler housing.

5. A fabric dryer according to claim 1 wherein said tumbler opening includes door opening margins, said tumbler assembly comprising a fixed tumbler housing forming at least a portion of said door opening margins.

6. A fabric dryer according to claim 5 wherein said fixed tumbler housing forms all of said margins of said door opening.

7. A fabric dryer according to claim 1 wherein said rotatable tumbling mechanism comprises first and second rotatable tumblers rotatably mounted about first and second axes respectively, said first and second axes being canted with respect to one another.

8. A fabric dryer according to claim 7 wherein said first and second tumblers each have outer peripheral edge portions which travel in first and second circular paths respectively during rotation of said first and second tumblers about said first and second axes, said first and second circular paths being a first distance apart at a first location along their circumferences and being a second distance apart greater than said first distance at a second location along their circumferences.

9. A fabric dryer according to claim 8 wherein said second location is adjacent said tumbler opening.

10. A fabric dryer according to claim 1 wherein said door is the only covering over said tumbler opening.

11. A tumbler assembly for a fabric dryer comprising:

a frame;

a tumbler housing mounted to said frame and having a top portion, a bottom portion, and opposite side portions forming a tumbler compartment having an upwardly presented tumbler opening therein;

first and second fabric grasping members movably mounted within said tumbler compartment for movement within said compartment in first and second circular paths respectively; said tumbler opening being stationary throughout movement of said first and second fabric grasping members in said first and second circular paths respectively.

12. A tumbler assembly according to claim 11 wherein said tumbler housing includes a fixed housing portion and a movable housing portion, said first and second fabric grasping members being carried by said movable housing portion.

13. A tumbler assembly according to claim 12 wherein said movable housing portion comprises first and second pan-shaped members rotatably mounted about first and second axes respectively.

14. A tumbler assembly according to claim 13 wherein said first and second axes are canted with respect to one another.

15. A tumbler assembly according to claim 11 wherein said first and second circular paths define first and second planes which are canted with respect to one another.

16. A tumbler assembly according to claim 15 wherein said circular paths each have an upper path portion adjacent said tumbler opening and a lower path portion, said upper path portions of said first and second circular paths being spaced apart a distance equal to or greater than the width of said tumbler opening.

17. A tumbler assembly according to claim 16 wherein said lower path portions of said first and second circular paths are closer to one another than said upper path portions.

18. A tumbler assembly according to claim 12 wherein said fixed housing portion surrounds said movable housing portion, and said movable housing portion is completely within said tumbler compartment.

19. A tumbler assembly according to claim 11 wherein said tumbler housing is free from means for covering said tumbler opening.

20. A tumbler assembly according to claim 17 and further comprising an air inlet within said tumbler housing positioned to introduce a hot air stream in a direction which passes between and across both of said first and second paths of said fabric grasping members.

* * * * *